United States Patent [19]

Tsurumi et al.

[11] 3,933,320

[45] Jan. 20, 1976

[54] APPARATUS AND PROCESS FOR AUTOMATICALLY SUPPLYING COPS TO A THREAD WINDER

[75] Inventors: Kotaro Tsurumi, Takatsuki; Shigeyuki Nishiyama; Kunio Nishimura, both of Amagasaki, all of Japan

[73] Assignee: Nihon Spindle Seizo Kabushiki Kaisha, Japan

[22] Filed: Aug. 29, 1973

[21] Appl. No.: 392,572

[30] Foreign Application Priority Data

| | | |
|---|---|---|
| Aug. 30, 1972 | Japan | 47-101745[U] |
| Sept. 4, 1972 | Japan | 47-88512 |
| Sept. 4, 1972 | Japan | 47-88513 |
| Sept. 4, 1972 | Japan | 47-88514 |
| Mar. 31, 1973 | Japan | 48-37038 |

[52] U.S. Cl. ..... 242/35.5 R; 242/35.6 R

[51] Int. Cl.[2] ..... B65H 54/20; B65H 54/26

[58] Field of Search ..... 242/35.5 R, 35.5 A, 35.6 R

[56] References Cited

UNITED STATES PATENTS

| | | | |
|---|---|---|---|
| 2,010,465 | 8/1935 | Reiners et al. | 242/35.5 A |
| 2,052,895 | 9/1936 | Reiners et al. | 242/35.5 R |
| 2,177,680 | 10/1939 | Abbott | 242/35.6 R |
| 2,208,930 | 7/1940 | Kahlisch | 242/35.6 R |
| 2,350,927 | 6/1944 | Reiners et al. | 242/35.5 A |
| 3,279,710 | 10/1966 | Raasch | 242/35.5 R |
| 3,421,705 | 1/1969 | Benedict | 242/35.5 R |
| 3,774,859 | 11/1973 | Brouwer et al. | 242/35.5 R |

*Primary Examiner*—Stanley N. Gilreath
*Attorney, Agent, or Firm*—Blum, Moscovitz, Friedman & Kaplan

[57] ABSTRACT

This invention relates to a method and an apparatus for automatically supplying cops to a thread winder wherein the inefficient manual operation of supplying the cops one by one into each of the cop-holding magazines mounted in juxtaposition to the thread winder can be dispensed with. To this end, the apparatus of the invention comprises, as an essential component, a travelling cop feeder with means for sequentially feeding a number of cops from a cop-containing section through a cop feed-out section thereof, means for receiving and holding the cops by a cop-holding and charging section mounted in the cop-receiving position below said feed-out section and transferring them automatically alongside the thread winder, means for stopping said charging section in a position registering with each cop-holding magazine in the thread winder by a stop position control device, and means for charging the cops into the cop pocket in said magazine. In addition, means are provided for sensing the presence or absence of cops in the cop housing in the magazine for selectively charging the cops held by said charging section; replenishing cops selectively and automatically into the cop-containing section of the travelling cop feeder; for maintaining the relative position between the cop-holding magazine and the cop charging section for preventing any malfunction in the charging of cops from said charging section into said magazine; and controlling the operation of the travelling cop feeder so as to halt it for every other magazine for cop delivery thereto when the feeder is proceeding in one direction and for each intermediate magazine for cop delivery thereto when the feeder is travelling in the opposite direction from its stroke end, either as a whole or separately, for enabling an efficient cop delivery to the thread winder and dispensing with manual operation.

18 Claims, 24 Drawing Figures

FIG-19.1
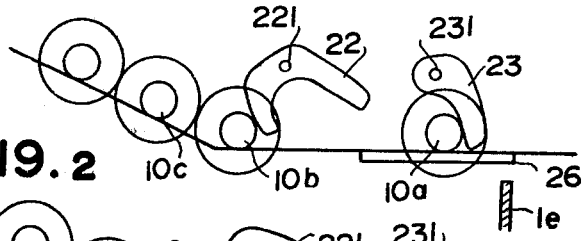
FIG-19.2
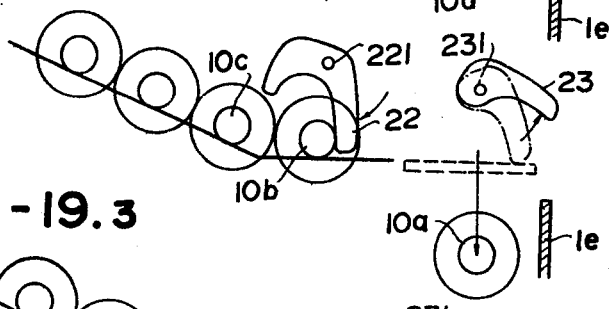
FIG-19.3
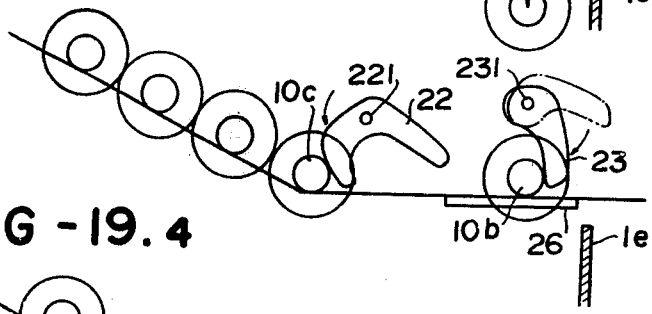
FIG-19.4
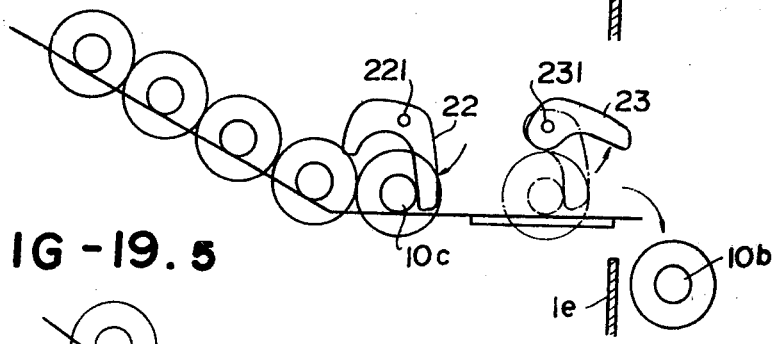
FIG-19.5
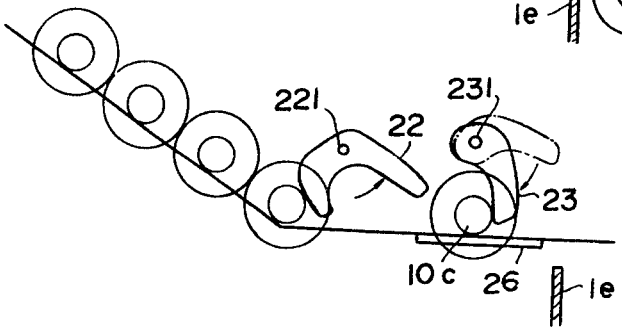

APPARATUS AND PROCESS FOR AUTOMATICALLY SUPPLYING COPS TO A THREAD WINDER

BACKGROUND OF THE INVENTION

Heretofore, when supplying the cops to each magazine of the winding units of an automatic thread winder, it has been necessary for an operator to make the round of the winder to watch for any magazines devoid of cops and to supply cops to such magazines by manual operation. This is an inefficient operation involving considerable time and labor and has proved to be a great hindrance to the full automation of the winder operation.

SUMMARY OF THE INVENTION

The present invention resides in a system for automatically supplying cops to an automatic thread winder comprising a travelling cop feeder adapted to travel along a thread winder and to stop in registry with a cop-holding magazine of each winding unit of the thread winder for automatically supplying cops to said magazine, said cop feeder including means for charging the cops through a cop-containing section and a feed-out section into a cop-charging section resting in readiness in a cop-receiving position beneath said feed-out section, and means for charging the cops from said charging section into said magazine when the charging section has been lowered to the charging position proximate to said magazine.

According to one aspect of the invention, the cop feeder adapted to travel alongside the thread winder for supplying the cops sequentially to the cop-holding magazine comprises a cop-containing section for holding a number of cops in parallel rows, a feed-out section for feeding the cops sequentially from said containing section, a cop charging section resting in readiness in the cop-receiving position beneath said feed-out section to receive and hold the cops supplied by descent from said feed-out section and adapted to be lowered to the cop-charging position proximate to a cop pocket in the cop holding magazine, a stop position control section for stopping the cop feeder in a position to register with said magazine, and a cop-charging control device for controlling the cop charging into said magazine depending on the presence or absence of a cop in said cop pocket.

According to another aspect of the present invention there is provided in conjunction to said cop feeder an automatic cop-replenishing device comprising a belt conveyor mounted alongside the machine frame of the thread winder and a chute device movable relative to the winder frame with its open end resting on said conveyor and oriented in a direction opposite to that in which said conveyor is moving, said chute device being designed as a receiving device for the cops being conveyed and having a floating device for lifting the travelling belt from its guide plate and a guide trough adapted to hold said articles from dropping unintentionally from the lifted belt and to guide and supply them by descent to said containing unit.

According to a further aspect of the present invention, there is provided a travel control device for said cop feeder whereby the latter is adapted to be stopped for every other magazine for cop delivery operation thereto when proceeding in one direction and for each intermediate magazine for cop delivery thereto when proceeding in the opposite direction.

According to a further aspect of the invention, in a cop feeder having a cop-charging section adapted to receive and hold cops and be lowered to a cop-charging position proximate to a cop-holding magazine in the thread winder for charging and supplying the cops into said magazine, there is provided an entraining device for carrying said charging unit rotatably for entraining it in rotation by said cop-holding magazine when the latter rotates as the cops are charged thereto and maintaining the relative position between said magazine and said cop-charging section.

According to a further aspect of the present invention, there is provided an automatic cop supply system comprising a travelling cop feeder adapted to travel alongside the winder and to supply the cops sequentially into a series of magazines arranged in an automatic thread winder, said cop feeder including means mounted in position above said thread winder for supplying a predetermined number of cops automatically into a hopper and operable so that the cops are supplied into a hopper from a cop conveying belt conveyor even while the cop feeder is travelling; the travel of the belt conveyor is controlled for stopping or running depending on whether the number of cops in said hopper lies between selected limits.

According to the present invention, since the cop feeder supplies the cops sequentially to each magazine as it travels in reciprocation alongside the thread winder, the waiting time can be reduced substantially to nil by setting the travelling speed of the cop feeder as a function of the time expended for cop replacement and reciprocation of the cop feeder. Moreover, full automation in the cop supply operation results in a saving in man-power and increases in operational efficiency and safety factor and, since the cops are charged to each magazine depending on the presence or absence of cops in the magazine, the risk of the malfunction and the resulting disorder can be completely eliminated. If desired, the cop-feeder can be programmed to replenish each magazine in sequence in a single travel direction of said cop-feeder, or in any other order desired, but servicing alternate magazines is preferred.

It is possible to feed cops into the opening of the guide trough in either of the travelling directions of the chute device mounted on the cop feeder and to elevate the belt above the guide plate by the use of lifting device; no hindrance is offered by the guide plate to the lateral deviation of the articles being conveyed. In addition, since the guide trough safeguards the articles from dropping unintentionally and guides them smoothly to the supply device, and the chute device can receive the articles from the belt conveyor as it travels alongside the winder frame, the cop supply apparatus can be run with a relatively small stock of cops and the cop-containing section and hence the cop feeder itself can be made compact in size.

According to the present invention, since the cop-charging section, i.e., cop-holder, is carried rotatably in a horizontal attitude, and means are provided for entraining the charging unit in rotation by the cop-holding magazine when the cop-holder is lowered to the charging position, the cop-holder is driven in synchronism with the magazine for cop delivery thereto even when the magazine is rotated, and the relative position between the two members remains unchanged, thus precluding malfunction in the cop-charging operation and the resulting damage or disorder and assuring saftey in the cop-charging operation.

Since, moreover, a charging control device comprising a cover plate which can be opened by the weight of the cop and returned to its starting position after charging the cop and means for controlling the opening and closure thereof is provided to the cop-charging section, the cop can be supplied to an empty cop pocket but cannot be supplied to a cop pocket already containing a cop since such a cop abuts at its upper end against the cover plate and thus hinders the latter from opening. Thus, the cop delivery can be carried out automatically and selectively as the presence or absence of the cops in the cop pocket is detected. When a cop is already stored in a cop pocket, the charging section is again elevated as it holds the cop to be charged for the next charging operation. By this, the malfunction of the apparatus can be eliminated and saving in man-power and full automation of the apparatus can be attained by means of a simplified mechanism which simultaneously assures high safety in operation.

Since the cop-feeder travels in reciprocation in front of the row of magazines and supplies the cops not only during the forward run but also during the return run thereof, there is no loss in the travel time and, since the feeder is halted for every other magazine during its forward run and for the intermediate magazines during its return run, the waiting time necessary for each magazine to be supplied with cops is lower than would otherwise be the case, thus resulting in the elimination of idle operation of the winding section and stress in the winder frame and assuring smooth running and halting of the cop feeder.

Since any change in the cop quantity in the containing section of the cop feeder is sensed by a sensing device while the cop feeder reciprocates and the cop-conveying belt conveyor is stopped on receiving an instruction signal from said sensing device while the cops are delivered into the feeder, the capacity of the containing section of the feeder and hence that of the feeder itself can be minimized, thus resulting in the smart appearance and cost reduction of the apparatus. Moreover, the feeder can travel at an enhanced speed with reduced inertia, while the stop position thereof is positively fixed, and the cops can be replenished to the moving feeder.

Accordingly, an object of this invention is to provide a method and an apparatus for automatically supplying the cops to a thread winder whereby the labor saving can be achieved through full automation of the winder operation.

Another object of this invention is to provide a simplified device which so operates that the cops can be charged into a cop housing or pocket in each cop holding magazine of the winding units of the thread winder where the cops are missing but not to the cop housing or pocket where the cops are stored.

A further object of this invention is to provide a simplified device for replenishing cops automatically to a cop feeder travelling alongside a thread winder. The device has a compact and simplified construction comprising a chute device and a belt conveyor and operates in such a way that the conveyor belt is floated above the guide plate as the chute device travels so that the articles being conveyed on the conveyor belt are deviated laterally over the lateral guide plate.

A further object of this invention is to provide a simplified cop charging device which so operates that the cops can be supplied accurately and automatically into each cop magazine in the thread winder even when the magazine rotates as the cops are charged thereto, and that the risk of double charging is eliminated through detecting the remaining cops in the magazine.

A further object of this invention is to provide a control device which so operates that the cop feeder travelling alongside the thread winder is stopped for every other magazine for cop delivery thereto, with resulting reduced circuit time and elimination of loss time and nonalignment of the stop position, and the cop feeder can be accurately stopped without any shock generation thanks to the provision of the mechanical positioning device.

A still further object of this invention is to make the cop hopper for the travelling cop feeder compact in size, and to automatically control the operation of the cop-conveying belt conveyor as a function of the cop quantity contained in the containing unit, in a way so that the cops can be positively and automatically supplied to the cop hopper in a predetermined quantity even while the cop feeder is travelling.

Yet another object of the present invention is a method of operating an automatic cop-feeder for loading cops into the magazine of a thread winder which minimizes the time necessary for attending to all magazines and minimizes vibration and shock in bringing the cop-feeder into registry with each magazine.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWING

For a fuller understanding of the invention, reference is had to the following description taken in connection with the accompanying drawings, in which:

FIGS. 19.1 to 19.5 show diagrammatically the selective feeding of cops to either or both of a pair of guide troughs.

DESCRIPTION OF THE PREFERRED EMBODIMENT

Figure 1:
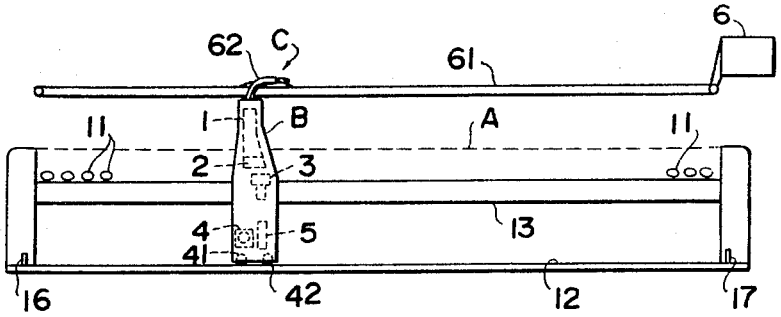
FIG. 1 is a front view of a cop-feeder in accordance with the present invention with a thread-winder and magazines indicated schematically.

In FIG. 1, an automatic thread winder A has a number of juxtaposed winding units (not shown), rotary type cop magazines 11 arranged in registry to said winding units for delivery and supply of cops to said winding units, and travelling and guiding rails 12, 13.

Figure 2:
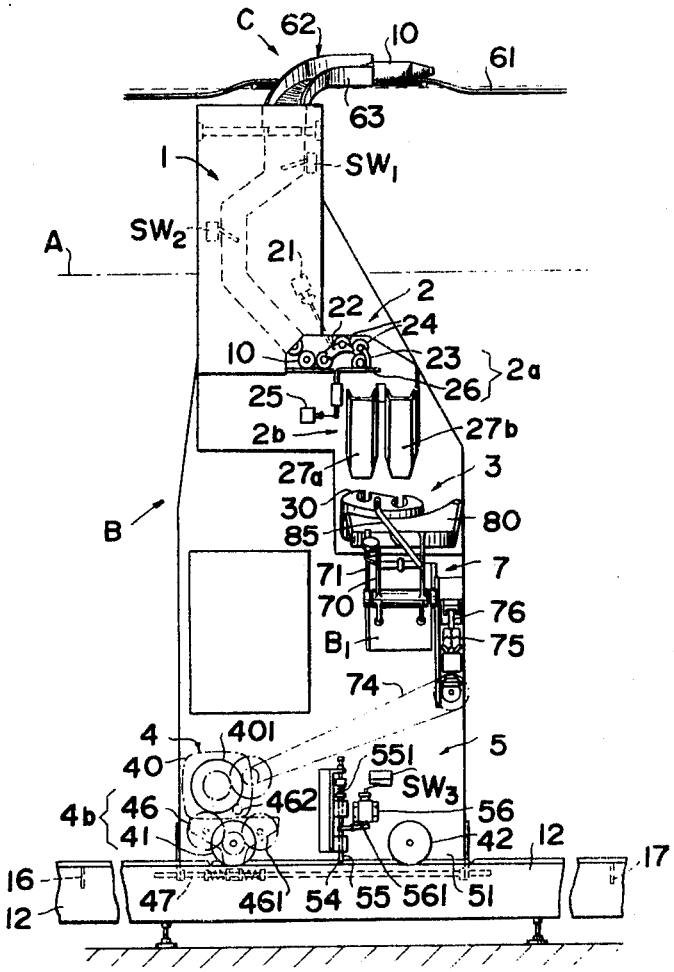
FIG. 2 is a front view of the cop feeder looking in the direction of the winder.
Figure 3:
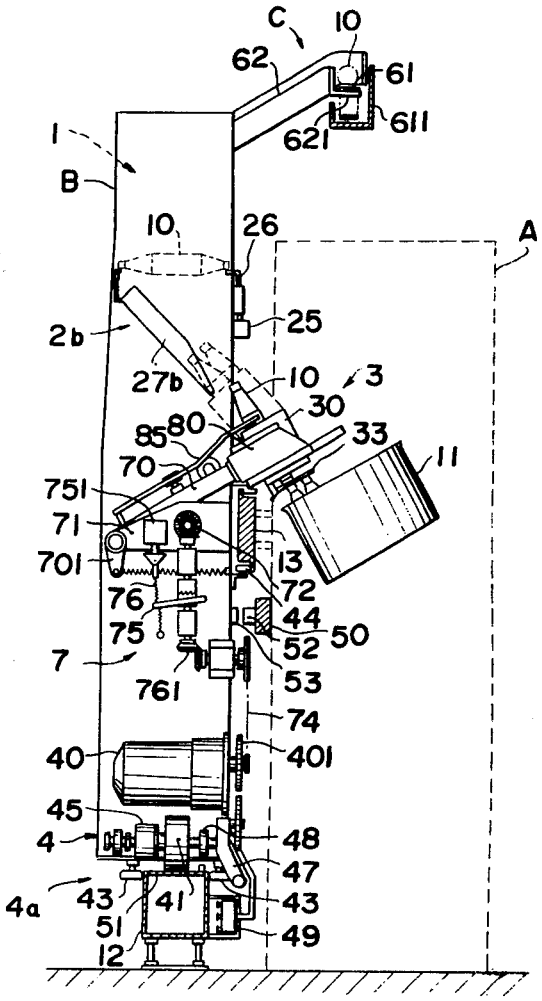
FIG. 3 is a side view of the cop-feeder shown in FIG. 2 and of a magazine in registry with said cop-feeder.
Figure 4:
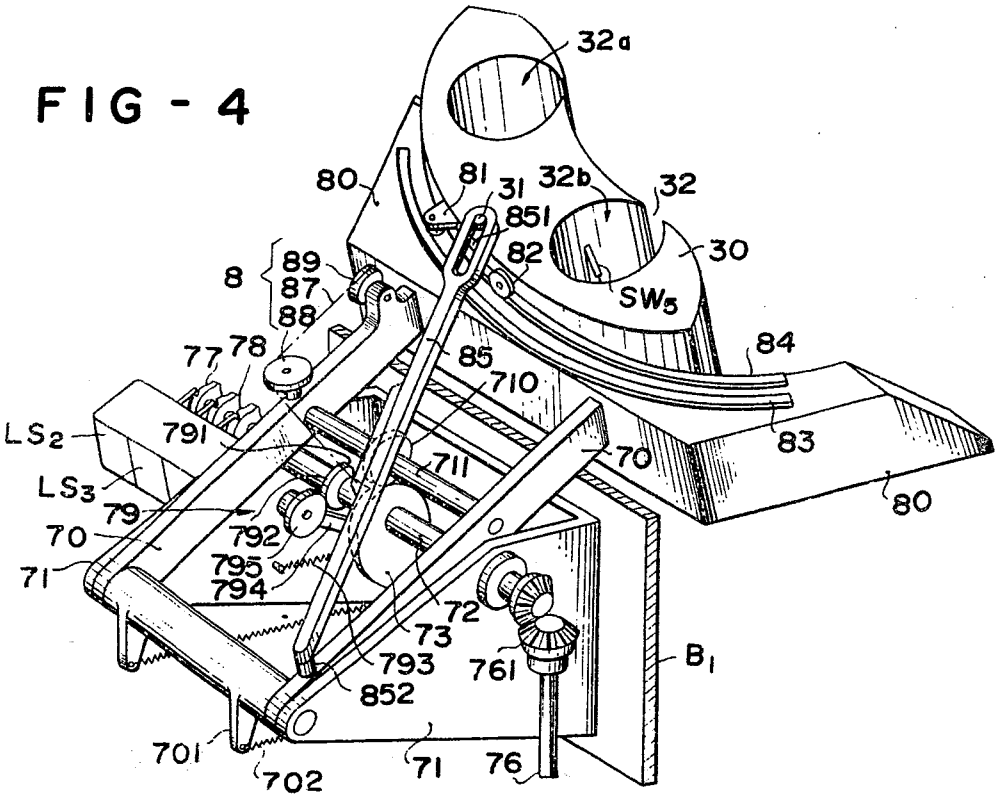
FIG. 4 is a perspective view of the charging unit.

B denotes a travelling cop feeder for supplying the cops automatically to the magazines 11 as it travels alongside the winder A. As shown in FIGS. 2 and 3, the travelling cop feeder B comprises a cop-containing section 1 having, for instance, a bent passage for storing a number of cops 10 in parallel rows; a feed-out section 2 formed by a feeding device 2*a* for feeding the cops sequentially from the containing unit and a guide trough 2*b* for guiding the cops therealong; a charging section 3 for receiving and holding the descending cops at the receiving position beneath the feed-out section and selectively charging the cops into the cop pocket of the magazine 11 when lowered to the charging position proximate to the magazine 11; a driving unit 4 for driving each above section and comprising a travelling unit 4*a* consisting of a drive roller 41, a driven roller 42 and guide rollers 43, 44 adapted for rolling on said guide rails 12, 13 for moving the feeder alongside the winder A and a changeover unit 4*b* for reversing the direction of travel of the cop feeder at the end extremity of the thread winder; and a stop position control section 5 for momentarily stopping the cop feeder when the latter is moved to a position registering with a magazine 11 of the thread winder A.

C denotes a unit for replenishing cops to the containing section 1 of the cop feeder B comprising a conveyor belt 61 mounted in position above the winder frame and a chute section 62 projectedly mounted on the top of the feeder proper B. Said chute section 62 is positioned with its open end resting on the conveyor belt and facing in a reverse direction to that of movement of the conveyor belt for picking up the cops 10 transferred on the conveyor belt as the feeder proper reciprocates and for guiding the cops laterally and supplying them into said container section 1. An internal passage is provided in the container section 1 of the feeder proper B for accommodating the cops 10 in a horizontal and end-to-end relation, and the upper and lower limit switches $SW_1$ and $SW_2$ (FIG. 2) are provided in suitable positions in the passage of the containing section 1 for sensing the quantity of cops stored in said passage.

These switches may be turned on and off for controlling the cop quantity supplied by the conveyor belt 61 and stored in the containing section.

In a modified embodiment (not shown), there may be provided a cop supply hopper to the winder frame for automatically supplying the cops therefrom into the cop-containing section 1 when the cop feeder B has reached the end extremity of the winder frame.

Feed-out section 2 provided at the lower end of the containing section 1 for feeding the cops 10 into the charging unit comprises an arcuate control member 22 pivoted at the arcuate portion thereof and connected at the other end to a solenoid 21 which allows a cop to be fed when energized but normally holds the cop in said member 22; a stop member 23 pivotally mounted at one end back of the control member 22 so as to stop the rolling of the cop 10 and to be rotated synchronously with control member 22 through gearing 24 to permit the passage of the cop; a movable support member 26 beneath said stop member 23 for carrying one end of the cop and connected to a, solenoid 25 so as to be rotated periodically to permit the descent of the cop selectively into either of a pair of juxtaposed guide channels 27*a*, 27*b* mounted respectively beneath said support member 26 and beyond the stop member 23 for guiding the cops to the charging section 3 from the rotating support member 26 and from beyond the support member 26. In this way, two cops can be fed out selectively from the feed-out section into the charging section 3, but one or two or more cops may be supplied simultaneously by decreasing or increasing the number of support members 26.

As shown in FIGS. 4 to 7, charging section 3 comprises a cop holder 30 for receiving and holding the cops 10 fed from feed-out section 2 by gravity; a lifting means 7 (FIGS. 2 and 5) for moving the holder 30 vertically to a cop-receiving position or to a cop-charging position proximate to the magazine 11; means 29 (FIG. 7) for synchronized rotation of the charging section 3 with that of the magazine 11 for maintaining the the charging position; a self-centering device 8 (FIGS. 4 and 5); and charging control means 9 (FIGS. 6*a* and 6*b*) for sensing the existence or non-existence of the cops in the cop pocket of the magazine 11 and accordingly charging the cops held by the holder 30 or refraining from charging them. Said lifting means 7 is so constructed that the cop holder 30 is carried movably by part of a lifting frame 70 (FIGS. 2, 4 and 5) pivotally mounted to stationary portion B, of cop feeder B and comprises cam 73 (FIGS. 4 and 5) mounted on cam shaft 72 rotatably carried at the ends thereof by brackets 71, and cam follower 710 mounted on transverse rod 711 which is mounted in turn on lifting frame 70. The lifting frame 70 can thus be swung essentially vertically with rotation of cam shaft 72.

An end gear on the cam shaft 72 engages with end gear 761 on rotatable shaft 76 connected to the driving means 40 of the driving section 4 through motion-transmitting means 74 (FIGS. 2 and 3) and magnetic clutch 75. The magnetic clutch 75 is controlled by switches $LS_2$ and $LS_3$ (FIG. 5) operated respectively by cams 77, 78 mounted on the end of cam shaft 72 and by sensor switch $SW_3$ (FIG. 2) in stop position control section 5. The operation of this section will be described below with reference to controlling the rotation of cam shaft 72.

A stop means 79 (FIG. 4) for cam-shaft 72 comprises a stop cam 792 having a recessed groove 791 and rotatable integrally with cam-shaft 72, and a roller 795 pivotally mounted at the base end to support bracket 71 and abutting with a light pressure on said stop cam 792 under the force of spring 793. This stop means engages and holds the cam shaft 72 as the lifting frame 70 is elevated to the receiving position for safeguarding the shaft 72 and the lift frame 70 from shifting during travel of the cop feeder B.

A spring 702 is mounted under tension between a boss 701 on the base end of lift frame 70 and the bracket 71 to resiliently compensate for any rotational moment due to the weight of the lift frame 70 and the holder 30. The self-centering device 8 is mounted to the foremost part of the lift frame 70 for pivotally carrying the holder 30 and comprises a swingable guide frame 80 having an arcuate shape concentric with that of the magazine 11 and formed with horizontal and vertical guide rails 83, 84 on the upper and the lower surfaces thereof, and guide wheels 81, 82 mounted on the back surface of the holder 30 are perpetually received within these guide rails so that the holder 30 is movable along the arcuate passage in synchronism with the magazine 11.

Self-centering operation of the holder 30 is attained by a device comprising a lever arm 85 having an oblong slot 851 at its end for engaging with a boss 31 on the holder 30 and pivotally mounted at its base end 852 to the lifting frame 70, and a traction cord 87 fastened to one of a series of openings 86 (FIG. 5) formed on the lever arm 85 and coupled at the other end with a weight, now shown, through rollers 88, 89. The lever arm 85 is forced into partial rotation under traction of the cord 87 for permanently positioning the holder 30 in the cop-receiving position.

Figure 5:
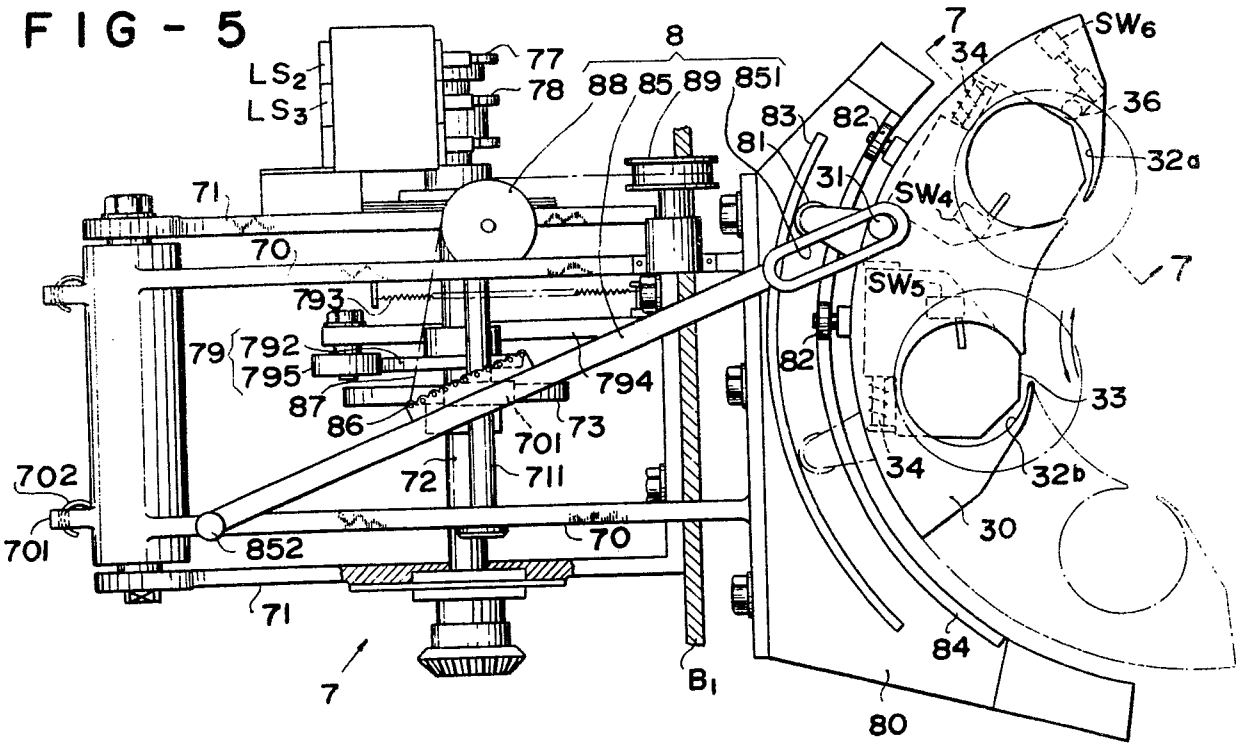
FIG. 5 is a plan view of the charging unit shown in FIG. 4.

As shown in FIG. 5, the holder 30 is formed into a sector shape having substantially the same radius of curvature as that of magazine 11 and is provided with a pair of longitudinal cop-receiving cavities 32*a*, 32*b* in registry with the guide channels 27*a*, 27*b* of the feed-out section 2 and with the distance between adjacent pockets 15 in magazine 11. As shown in FIGS. 5, 6*a*, 6*b* and 7, cover plates 33, 33 are pivotally mounted adjacent to the lower ends of the cavities 32 and the cover plate 33 is urged to move upwards by a spring 332 (FIG. 7) mounted about pivot 331. The spring force of the spring 332 is selected to be such that the cover plate 33 is normally held against the open end of the cavity 32 but can be lowered under the weight of the cop contained within the cavity 32.

Said cover plate 33 may be made from a thin resilient plate and secured at the base end and in this case, the spring 332 may be dispensed with.

Figure 7:
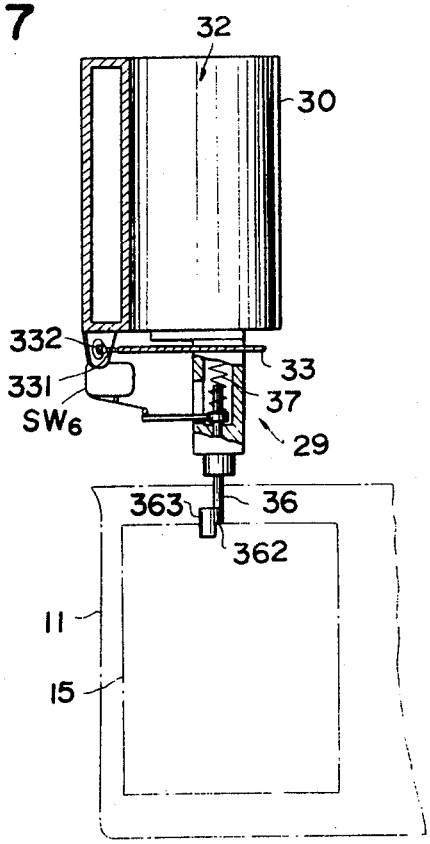
FIG. 7 is a sectional side view taken on the line 7—7 of FIG. 5.
Figure 6B:
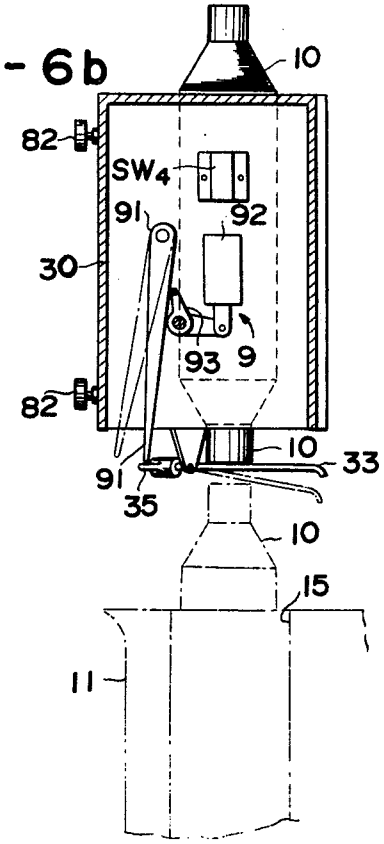
FIGS. 6*a* and 6*b* are sectional side views of the charging unit at the time of a cop-charging operation.
Figure 6A:
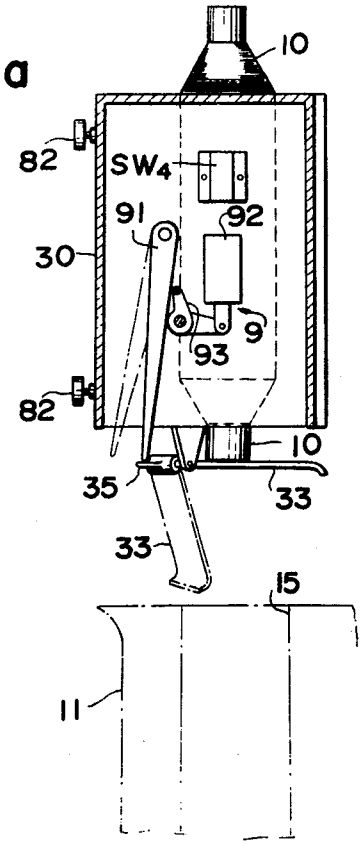

A charging control device 9 is provided as shown in FIGS. 6*a*, 6*b* and 7 at the base end of the cover plate 33. This charging control means 9 comprises an engaging lever 91 pivoted at its upper end and contacting at its lower end projection 35 on the base end of the cover plate 33, and control lever 93 mounted in proximity to said engaging lever 91 and adapted for partial rotation on energization of a solenoid 92 for disengaging the lever 91 from the projection 35 on the cover plate 33. The arrangement is such that, as the holder 30 is lowered, cover plate 33 is opened by disengagement of the lever 91 from the projection 35 thus permitting the cop to drop of its own weight, but if there is already a cop in the cop-receiving pocket 15 (FIG. 7) in the magazine, the cover plate 33 is prevented from opening by its contact with the top end of the cop (FIG. 6*b*), and kept closed by reengagement of the lever 91 with the projection 35 just before the holder 30 starts its upward stroke. In this way, the charging of the cops 10 can be controlled through sensing the presence or absence of cops in individual pockets of the magazine 11. Detector switches $SW_4$ and $SW_5$ (FIG. 5) provided with feeler means facing to the inside of the cavities 32 or photocell type detectors (not shown) are also mounted in opposition within said cavities 32*a*, 32*b* for detecting the existence of cops in the cavities 32 for selective actuation of the feed-out section 2. Said holder 30 usually holds one or more cops for charging them simultaneously into the magazine.

Figure 18:
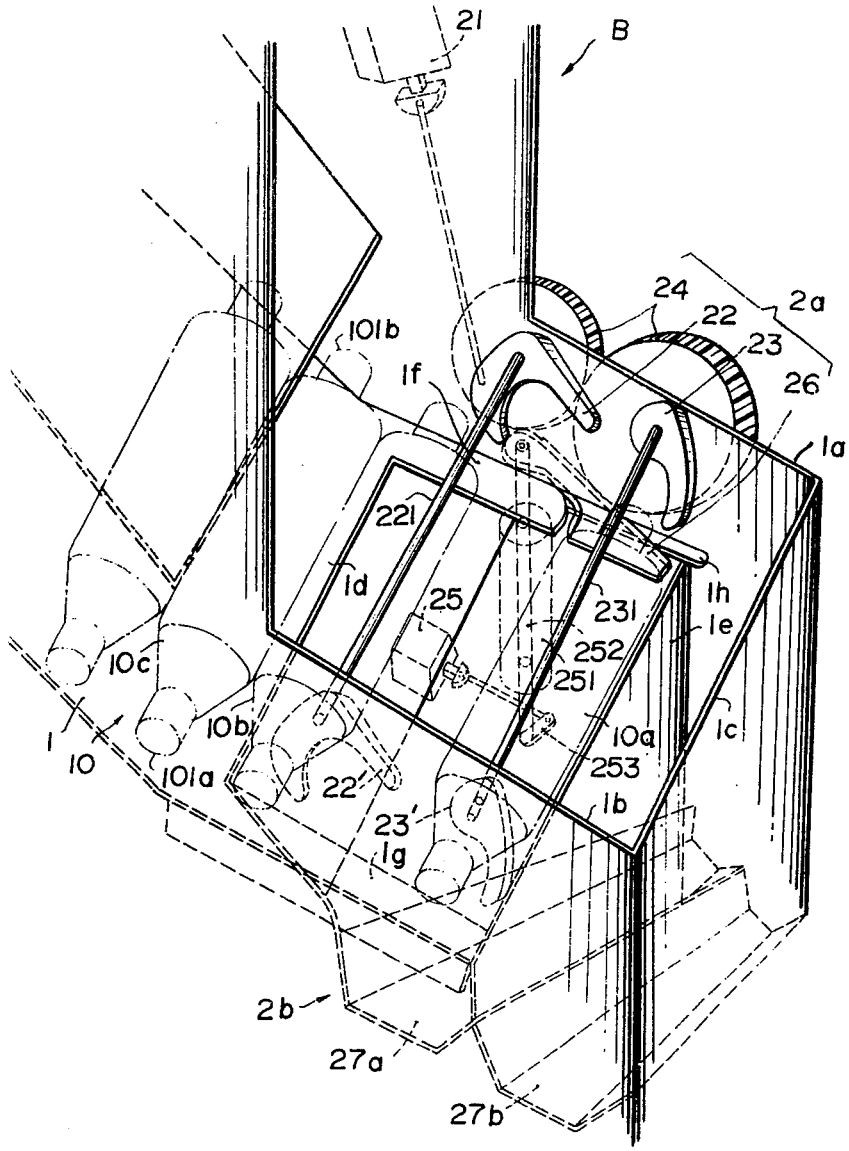
FIG. 18 is a perspective view in greater detail of portion 2 of FIG. 2.

The structure of feedout section 2 is shown in more detail in FIGS. 18 and 19.1 to 19.5. Referring first to FIG. 18, the feed-out section 2 is disposed beneath the containing section 1 and comprises the feeding device 2*a* for feeding two cops 10 sequentially to the charging section 3 and the guide trough 2*b* for guiding the thusly-fed cops therealong.

The feeding device 2*a* is disposed beneath the end opening of the bent passage of the containing section 1 and includes shafts 221 and 231 extending across the machine frame between side wall 1*a* which is positioned closer to the thread winder and side wall 1*b* which is positioned opposite to the side wall 1*a*, said shafts being rotatably carried by and protruding through the walls 1*a* and 1*b*. At the frame sides of the side walls 1*a* and 1*b*, there are mounted, respectively, control members 22 and 22′ and stop members 23 and 23′ on each of the shafts 221 and 231. The control member 22 is pivoted at the arcuate portion thereof and connected at the other end to solenoid 21 so as to prevent the feeding of the cop at its normal position. When the solenoid 21 is energized, the control member 22 is allowed to guide one cop to its arcuate portion, which cop is passed to the stop member 23 when the control member is turned back to its normal position, whereby the cops are sequentially fed one by one. Engaged gears 24 are fixedly mounted, respectively, on shafts 221 and 231 at their end portions protruding outside of the side wall 1*b* for rotating said shafts 221 and 231 synchronously in opposite directions.

The bottom plate of the bent passage of the containing section 1 is extended to form carriage portions 1*g* and 1*f* for carrying end portions 101*a* and 101*b* of the bobbin of the cop 10 to transport said cop 10 from the containing section 1 to the control member 22 and the stop member 23. The carriage portion 1*f* is shortened to extend only to the position substantially central of the extension from the control member 22 to the stop member 23. Along the extension from the control member 22 to the stop member 23, there is provided on the side wall 1*a* a slit 1*h* extending from the position substantially central of said extension for allowing insertion or removal therethrough of a swingable carriage plate, i.e., support member 26 which when inserted into the machine frame through slit 1*h* provides the remaining carriage pass for the end portion of the bobbin of the cop 10. The swingable carriage plate or support member 26 is fixedly mounted on rotatable shaft 252 which is rotatably carried by a bearing ring 251 disposed outside of the side wall 1*a*. The shaft 252 is rotated by a solenoid 25 through a lever 253 mounted at the bottom end thereof.

Further provided at the forward ends of the support member 26 and carriage portion 1*g*, i.e., in the forward and downward direction of the stop member 23, are oppositely positioned separate plates 1*e* which are spaced from each other by a predetermined spacing for allowing the cop 10 to fall down therethrough.

Beneath the aforementioned feeding device 2*a* there is provided guide trough 2*b* for receiving the cop 10 directly passed from or beyond the support member 26 and for transferring the same to the charging section 3, said trough comprising a pair of juxtaposed guide plates 27*a* and 27*b*.

The operation of the feeding device 2*a* is presented with reference to FIGS. 19.1 to 19.5.

As shown in FIG. 19.1, the series of cops 10 sliding down from the containing section 1 are aligned sequentially and the first cop 10*a* is fed to the feeding device 2*a* but the subsequent cops are stopped by the control member 22 having arcuate portions with pointed end portions which abut against both end portions 101*a* and 101*b* of the bobbin.

When both slots 32*a* (FIG. 7) and 32*b* of the holder 30 are empty and receive no residual cops, detector switches SW4 and SW5 energize the solenoid 21 (FIG. 18) and 25 to rotate the gears 24 (FIG. 18) synchronously, which in turn rotate the control member 22 (FIGS. 19.1 and 19.2) and the stop member 23 in opposite directions to feed cops to the slots 32*a* and 32*b*.

As the result of this rotating operation, the cop 10*a*, which has been stopped by the stop member 23 and previously been supported by the carriage portion 1*g* at one end portion 101*a* and supported at the other end by the support plate 26, is now supported at only one end as the support plate 26 is removed from the carriage position, whereupon the cop 10*a* falls down onto the guide plate 27*a* with the end portion 101*b* turning to the downward side.

As shown in FIG. 19.3, the solenoids 21 and 25 are then deenergized to return back to the original position, whereupon the control member 22 is restored to its original position with the next cop 10*b* engaged with the arcuate portion thereof. The cop 10*b* is, thus, passed through the control member 22 to roll to the stop member 23 and stopped thereby.

Referring to FIG. 19.4 showing the next operation mode of the feeding device 2*a*, only the solenoid 21 is energized with the support member 26 maintained in its carriage position to rotate the stop member 23 which has stopped the cop 10*b*, whereupon the cop 10*b* is passed through the stop member 23 beyond the separate plate 1*c* and dropped onto the guide plate 27*b* with the end portion 101*b* turning to the downward side.

The solenoid 21 is then deenergized to restore the whole arrangement to the original or normal position with the cop 10*c* held by the stop member 23 as shown in FIG. 19.5.

In the case where either of the slots 32*a* and 32*b* of the holder is empty, either the stop member 23 or the support plate 26 is moved by the signal from the corresponding switch SW4 and SW5 to provide selective cop feeding.

As shown in FIG. 7, an engaging lever 36 has a hook 363 provided with a step 362 engageable with the rim of one of the cop-receiving pockets arranged in a circle in magazine drum 11. The engaging lever 36 is resiliently carried by means of a spring 37 by the lateral surface of the cop holder 30 and is normally projected downwards under the force of the spring 37. The downward movement of the cop holder 30 is sensed by a microswitch $SW_6$ which thus controls the extent of descent of the holder 30 and detects whether the cavity 32 in the holder 30 is correctly aligned with the top of the receiving socket 15 in the magazine 11. The device so far described is also used as entrainment means whereby the holder 30 can be rotated in synchronism with rotation of the magazine drum 11 when the latter rotates.

Said engaging lever 36 is normally urged downwardly by spring 37 and, when the cop holder 30 descends and the hook portion 363 on the lower end of the engaging lever protrudes into and engages with the cop receiving pocket 15 in the magazine 11, the cop holder 30 rotates simultaneously with rotation of the magazine 11. When the magazine 11 is in the course of rotation and the engaging lever 36 does not descend to the predetermined limit, swtich $SW_6$ is turned on for momentarily stopping the descent of the engaging lever 36.

The travelling section 4*a* (FIG. 3) mounted on the lower part of the cop feeder B comprises a driving roller 41 (FIG. 2) and a driven roller 42 both rolling on the rail 12, guide rollers 43 (FIG. 3) rolling on the lateral faces of the rail 12 for preventing the lateral deviation of the cop feeder B, and a guide roller 44 rolling on guide rail 13 mounted on the lateral surface of the thread winder A. The shaft of the drive roller 41 is provided at one end with a braking device 45 of low braking power and is connected at the other end to a motion transmitting device 46 through magnetic clutch 48 (FIG. 3) for driving simultaneously by the driving means 40.

The lower part of the cop feeder B is provided with a changeover unit 4*b* (FIG. 2) consisting of drive roller 41 and motion transmitting device 46. The changeover unit 4*b* may be so designed that a slidably mounted push rod 47 is mounted engageably with a swingable plate 461 of motion-transmitting device 46. The ends of rod 47 project from both sides of the cop feeder B for making a changeover of the device 46 and reversing the rotation of the driving roller 41 when contacting stops 16 and 17 at both ends of the winder A at the end of the stroke of the push rod 47. In the alternative embodiment shown in FIG. 11, a changeover switch $LS_1$ is provided in proximity to a flange 471 mounted on a push rod 47. The push rod 47 abuts on the stops 16, 17 at the stroke end and operates switch $LS_1$ for making a changeover of the travelling control circuit and reversing the direction of movement of the cop feeder B.

The motion-transmitting device 46 (FIG. 2) carries a gear train on the swingable plate 461 with the shaft of drive roller 41 as center. The gear train meshes permanently with the gear of the drive roller 41 and can be disengaged from drive gear 401 of the drive unit 40 for reversing the rotational direction through idler gear 462.

Stop position control section 5 is so designed that the charging unit 3 of the cop feeder B can be halted in a position accurately registering with the cop pocket of the magazine 11 of the thread winder A and comprises an electrically operated primary control device and a mechanically operated secondary control device as shown in FIGS. 2 and 3. The primary control device comprises a magnet 52 (FIG. 3) mounted on a positioning plate 50 secured to the winder A and in a registering position to the magazine 11. The magnet 52 operates a reed switch 53 fixed to the cop feeder B when the reed switch is positioned facing to the magnet and disconnects the clutch 48 of the driving unit 4 thus causing the cop feeder B to coast by inertia. The secondary control device is so arranged that the feeder can be stopped precisely by a pin and groove connection comprising a detent pin 55 (FIG. 2) resiliently abutting on a positioning plate 51 on the winder A by a spring so as to be engageable with a groove 54 formed on the positioning plate 51 in the position facing to the magazine 11; a solenoid 56 for forcibly lifting the detent pin 55 from the positioning plate 51, and a switch $SW_3$ for sensing the engagement of the detent pin 55 with the groove 54 on the positioning plate 51. The cop feeder B can be positively stopped and held in the stop position by engagement of the detent pin 55 with the groove 54 on the positioning plate.

In FIG. 3, the numeral 49 denotes a unit mounted on the cop feeder B for receiving the current from the feeder line provided to the lateral face of the rail 12, the numeral 462 (FIG. 2) an idler permanently engaging with driving gear 401, the numeral 551 a pressure spring, the numeral 561 a shifter, the numeral 63 a chute guide for chute device 62, the numeral 611 (FIG. 3) a belt guide for conveyor belt 61, the numeral 621 a belt lift for chute device 62, the numeral 751 a solenoid for magnetic clutch 75 and $B_1$ (FIG. 4) a machine frame of the cop feeder B.

The apparatus so far described with reference to FIGS. 1 to 7 operates as follows:

The cop feeder B travelling on the rails with cops 10 held in the cop holder 30 assumes the cop-receiving position isolated from the row of magazines 11 and out of contact with any of the sections of the thread winder A. When the cop feeder B approaches a magazine 11, the magnetic clutch 48 and the brake device 45 are actuated by means of the electrically operated primary control device comprising a combination of the magnet 52 and the reed switch 53 and in a position ahead of the magazine by a predetermined angular measure. The drive roller 41 is now disconnected from the drive device 40 and, from that time, the feeder B travels by inertia at a reduced speed.

As the detent pin 55 of the mechanically operated secondary control device of the stop position control unit 5 snaps into the groove 54 on the positioning plate 51, the cop feeder B is stopped, and the switch $SW_3$ transmits an instruction signal for starting the cop supply for operating the magnetic clutch 75 and thereby setting the lifting means 7 into actuation. The rotary shaft 76 and the cam shaft 72 are now rotated and the lifting frame 70 is lowered to the cop-charging position in which the holder 30 is brought close to the magazine 11. The clutch 75 is disconnected by operation of the cam 77 and the switch $LS_2$ facing thereto. When the engaging lever 36 engages with a cop-receiving pocket 15 in the magazine 11 and hook 363 engages with the rim of the socket 15, as the cop holder 30 is lowered, the latter precisely assumes the cop-charging position, and the switch $SW_6$ is not in operation.

The solenoid 92 of the charging control device 9 is energized instantly for rotating the lever 93 partially and disengaging the lever arm 91 from its contact with the projection 35 on the cover plate 33. The cop 10 so far held on the cover plate 33 is now dropped upon opening of the cover plate and charged into the cop-receiving pocket 15 in the magazine 11 (FIG. 6*a*).

If there are no cops in the two receiving pockets 15 of the magazine 11, two cops are charged simultaneously from the cop holder 30 and, if a cop or cops are held in one or both of the receiving pockets 15, rotation of the cover plate 33 is hindered by its abutment with the upper end of the remaining cop, as shown in FIG. 6*b*, even when the engaging lever 91 is disconnected from the projection 35. Thus, the cover plate 33 is not opened, and the cop-charging operation does not take place. When the engaging lever 91 is turned to its starting position prior to the elevation of the cop holder 30, the engaging lever 91 again engages with the projection 35 of the cover plate 33. Thus the cop is not supplied to the magazine charged with the remaining cop, but again held and stored in the cop holder. According to the present invention, the presence or absence of cops in the magazine 11 can be sensed by a highly simplified mechanism for attaining selective cop charging into the magazine.

When the timing of descent of the holder 30 of the cop charging section 3 coincides with that of the revolution of the magazine 11 of the thread winder A, the engaging lever 36 abuts on the upper surface of the magazine 11 in the course of descent of the cop holder 30, and does not snap into the cop receiving pocket 15. Thus, the switch $SW_6$ is depressed for the time being for halting the holder 30 in the abovementioned position, while the solenoid 92 of the charging control means 9 is not energized. As the magazine 11 rotates further and the engaging lever snaps into the cop-receiving pocket 15, the holder 30 is entrained in rotation by the magazine 11. The above-mentioned cop charging process is started when the cop-receiving socket 15 in the magazine 11 is correctly aligned with the slot 32 in the holder 30 and ready for cop charging.

When the magazine 11 is rotated for cop exchange operation while the cop is being charged from the holder or while the cop is held by both the magazine 11 and the holder 30, since the hook 363 of the engaging lever 36 of the entraining means 29 is engaged with the rim of the cop receiving pocket 15 in the magazine 11, the holder 30 is entrained in rotation integrally with rotation of the magazine and travels therewith along guide rails 83, 84 of guide frame 80. The cop charging can thus be completed in the manner described above while the relative position is maintained positively between the cavity 32 in the holder 30 and the cop-receiving pocket 15 in the magazine 11.

Upon completion of the cop-charging operation, the control lever 93 of the charging control device 9 is returned to its starting position, while the holder 30 is elevated to its starting position and halted there by the cam shaft 72 under operation of the clutch device 75, and the detent pin 55 of the stop position control section 5 is detached simultaneously from the groove 54 on the plate 51. In this way, the driving roller 41 of the travelling unit 4*a* is set into rotation for transferring the feeder to the next magazine where the charging operation is repeated in the manner as described in the foregoing.

When the holder 30 is elevated to the cop-receiving position beneath the feed-out unit 2, the cop 10 is checked for its presence in the holder 30 by means of the sensor switches $SW_4$ and $SW_5$, having feeler means intruding into the cavities 32*a*, 32*b* of the cop holder 30. The solenoids 21, 25 are energized in accordance with the presence of the cops thus checked by the sensor switches for selectively supplying the cops into the cop holder 30.

Figure 11:
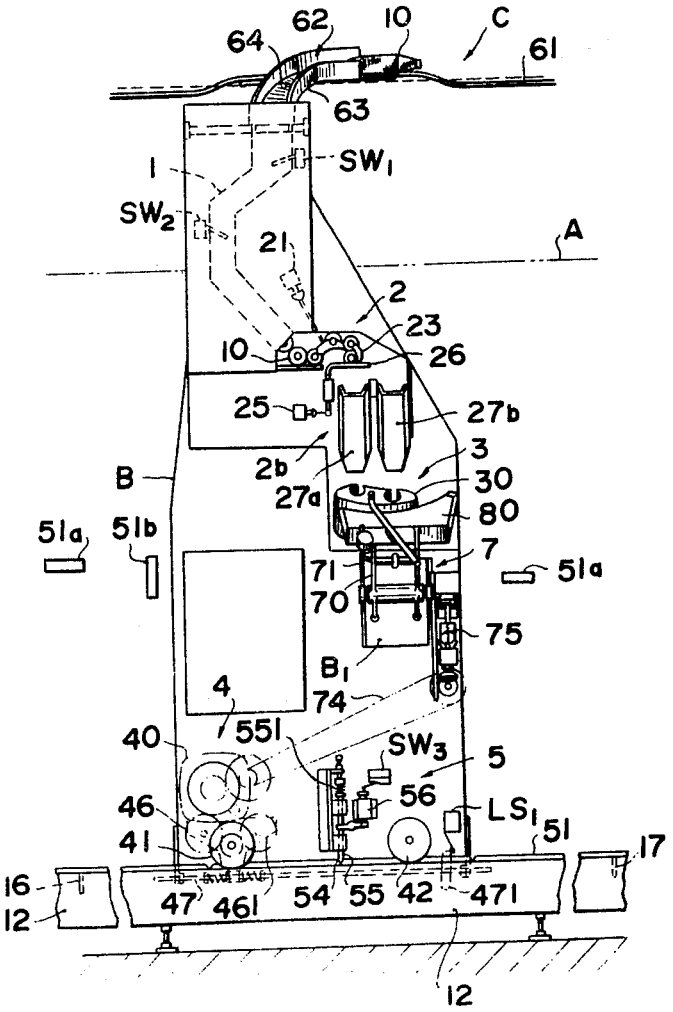
FIG. 11 is a front view showing an embodiment of the stop position control unit for the cop feeder.
Figure 12:
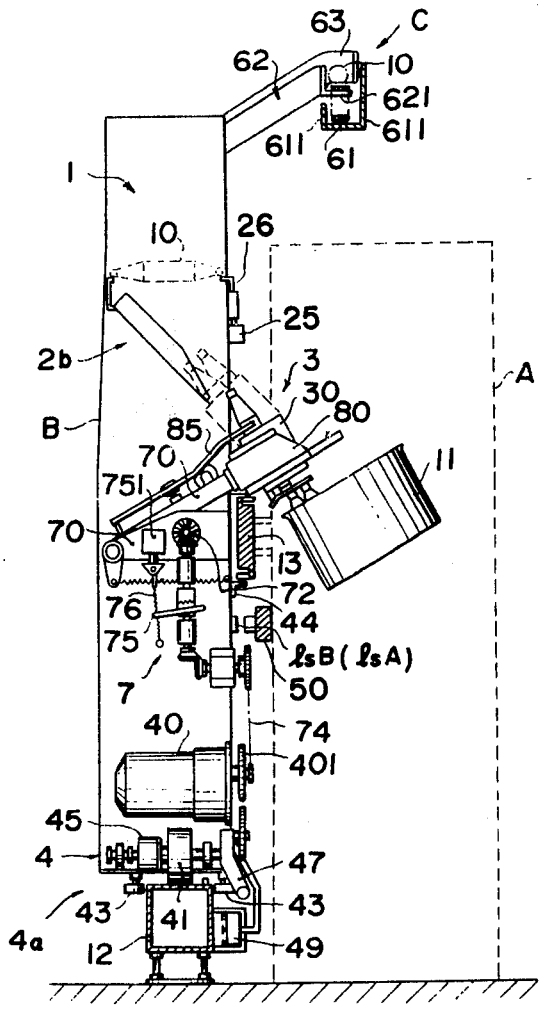
FIG. 12 is a side view of the unit of FIG. 11.

The stop position control unit 5 may be constructed as shown in FIGS. 11 and 12 wherein the cop holder 3 of the cop feeder B is brought to a stop in a precisely registering position with the cop pocket in the magazine 11 and for every alternate magazine mounted on the thread winder A while the feeder B proceeds in the one direction and for the intermediate magazines while the feeder proceeds in the other direction for its return traverse. This construction can be realized by providing a suitable electric circuit to the cop feeder whereby every other signal transmitted from the positioning plates mounted suitably on the machine frame of the thread winder with the pitch of the magazines is sensed for operating the magnetic clutch 48 of the driving roller 41 and the braking device 45, or providing two series of positioning plates alternately on the winder and two series of sensing means on the feeder corresponding to said positioning plates and making a changeover at the stroke end of the feeder between said two series of sensing means.

In the present embodiment, magnetized rectangular positioning members 51*a*, 51*b* (FIG. 11) are arranged on the positioning plate 50 on the winder A so that every other positioning member is placed perpendicular to the general direction of the positioning members. Two reed switches *ls*A, *ls*B are mounted at right angles to each other on the cop feeder B so that these reed switches can be turned on when registering with the respective directions of the positioning members 51*a*, 51*b*. These switches *ls*A, *ls*B are connected in parallel in the stopping circuits 94A, 94B (FIG. 13) of the travel control circuit 94 of the travelling unit 4*a* for making a changeover between the two stop circuits by operation of the changeover switch $LS_1$ of the changeover unit 4*b*.

Figure 13:
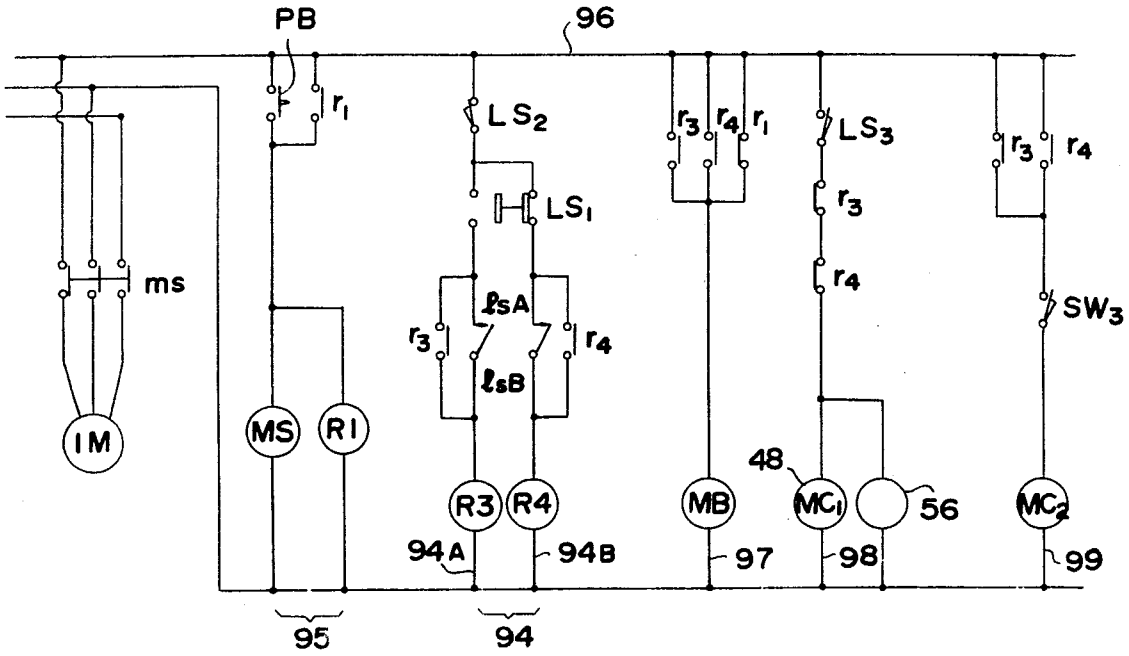
FIG. 13 is a circuit diagram for the charging unit and the lifting unit of the cop feeder.
Figure 14:
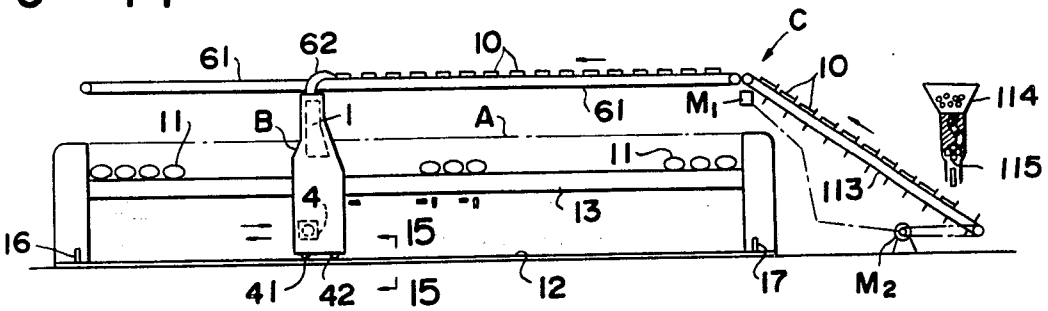
FIG. 14 is a schematic front view of the overall device according to a modified embodiment of the invention.
Figure 15:
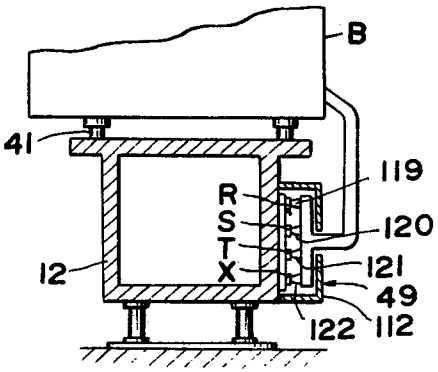
FIG. 15 is an enlarged sectional side view taken on the line 15—15 of FIG. 14.
Figure 16:
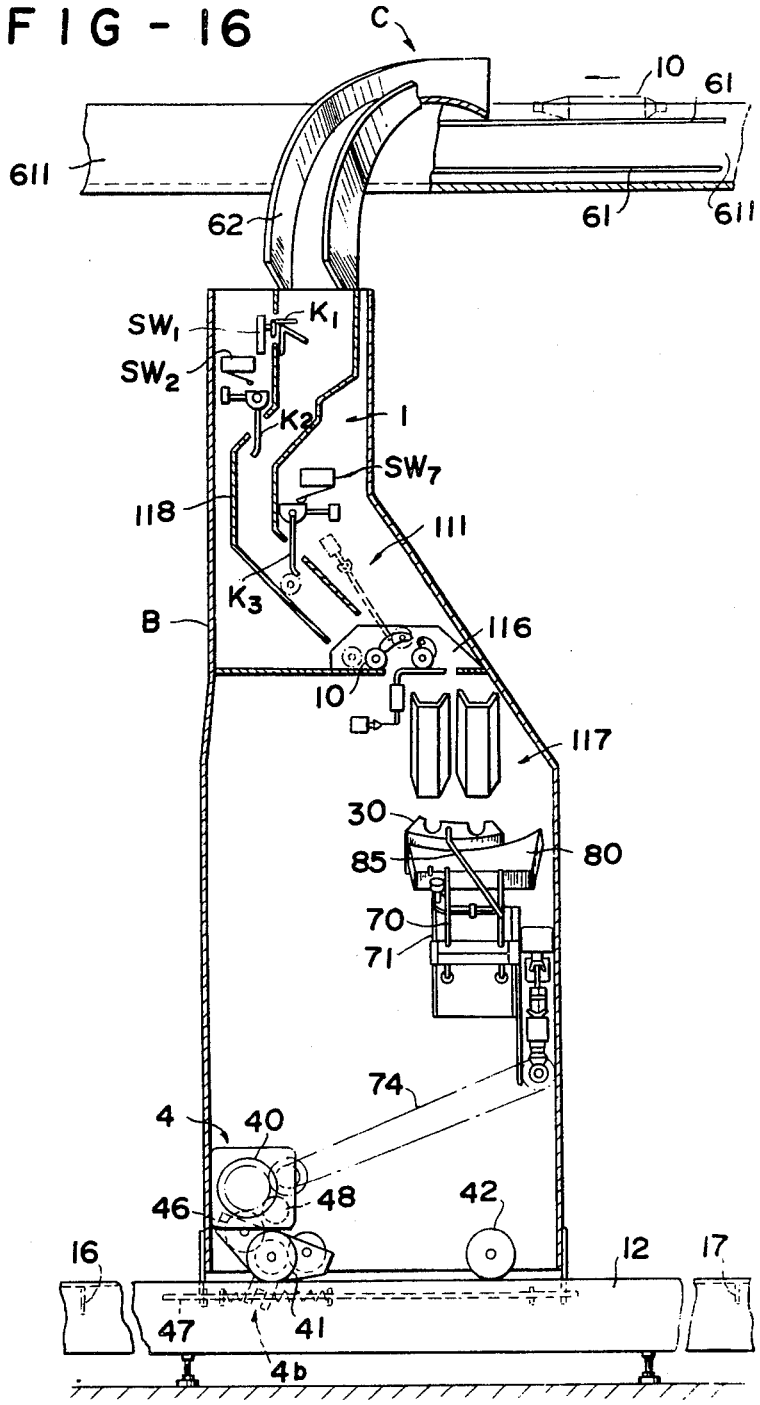
FIG. 16 is an enlarged sectional front view of the feeder.

The stop position control unit 5 (FIG. 11) consists essentially of an electrically operated primary control means operable to turn on reed switches *ls*A, *ls*B (FIG. 12) mounted on the feeder B when the latter are brought into registering position with the positioning members 51*a*, 51*b* (FIG. 11) for disconnecting the clutch 48 (FIG. 3) of the travelling unit 4*a* for setting the feeder B into inertia rolling and a mechanically operated secondary control means whereby the feeder can be stopped accurately along the rail, as in the preceding embodiment, but the unit 5 of the present embodiment has an electrical circuit for controlling the travel and operation of the feeder, as illustrated in FIG. 13.

Driving circuit 95 is so designed that starter push button PB energizes a magnetic switch MS and a relay $R_1$, and motor IM of the drive unit 40 is permanently driven by the self-hold of relay $R_1$.

The travel control circuit 94 comprises two parallel stop circuits 94A, 94B for feeder travel, one of which is selectively connected by changeover switch $LS_1$ of the changeover unit 4b to an operating electrical source 96. The control of the on-off performance of the changeover switch is associated with operation of the microswitches $LS_2$, $LS_3$ mounted in opposition to the cams 77, 78 secured to the end of the cam shaft 72 of the lifting unit 7. These stop circuits 94A, 94B are formed by series connections of reed switches *ls*A, *ls*B mounted facing positioning members 51*a*, 51*b* secured to the winder A, and by relays R3, R4 to be energized respectively by these switches *ls*A, *ls*B. As the relay R3 or R4 is energized, the magnetic braking device MB, connected to the braking circuit 97, is operated at the same time that the travel circuit 98 including a parallel connection of the magnetic clutch 48 of the travel unit 4a and the solenoid 56 of the stop position control section 5 is opened for deenergizing the solenoid 56 and the magnetic clutch 48 simultaneously. The detent pin 55 abuts slidingly on the positioning plate 51 under the force of spring 551 until it snaps into the groove 54 to positively stop the feeder.

Operating circuit 99 of the lifting unit is turned on by the sensor switch $SW_3$ of the stop position control unit 5 when any one of the stop circuits 94A, 94B is turned on and the detent pin 55 of the control unit 5 has snapped into the groove 54 of the positioning plate 51 to stop the feeder B in position. The magnetic clutch device 75 ($MC_2$) of the lifting unit 7 is now connected and the control cam shaft 72 of the lifting unit 7 starts its rotation. The holder 30 is now lowered for charging the cop into the magazine 11 and again raised to its original position by one full revolution of the cam 73 mounted on the cam shaft. While the switches $LS_2$, $LS_3$ are normally closed by the cams 77, 78 mounted on the cam shaft 72, the switch $LS_2$ is opened momentarily in the course of revolution of the cam shaft 72 for disconnecting the magnetic clutch device 75 ($MC_2$). The control shaft 72 and hence the lifting frame 70 is now no longer driven and allowed to rotate by inertia for a predetermined period. Thereafter, the switch $LS_3$ is depressed and closed to make the travelling circuit 98. The solenoid 56 of the stop position control unit 5 is now energized, and the detent pin 55 is elevated from engagement with the groove 54 of the positioning plate 51, while the magnetic clutch 48 is connected for setting the driving roller 41 into rotation and starting the travel of the cop feeder, and the switch $LS_2$ is again closed. The cop feeder is thus moved to the next stop position.

Figure 8:
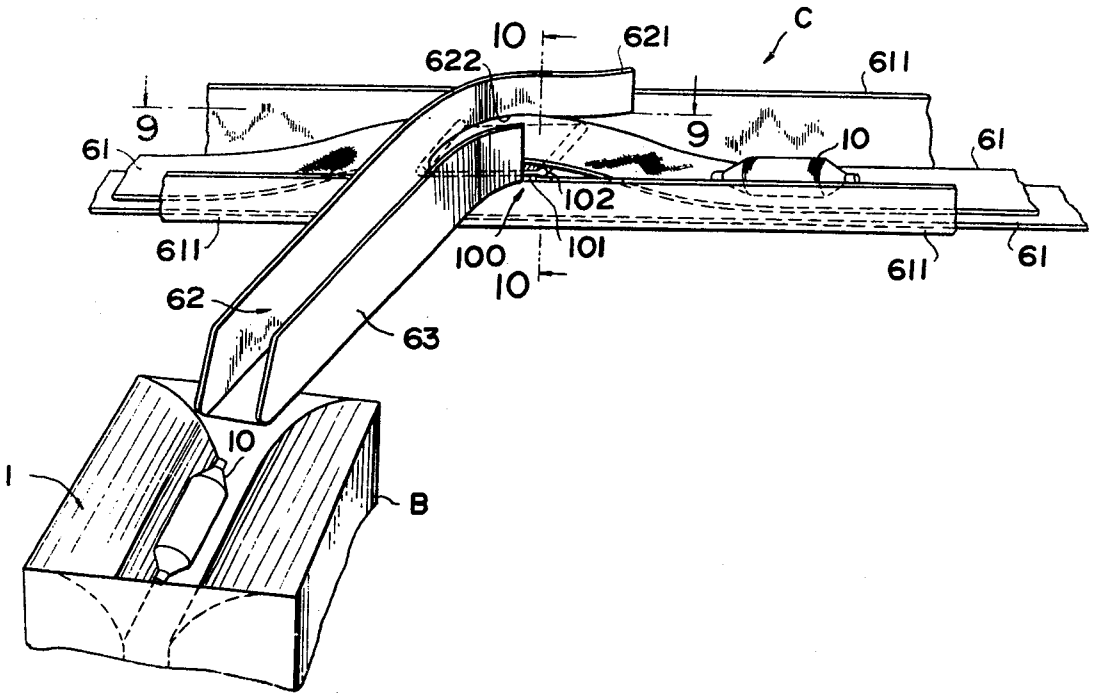
FIG. 8 is a perspective view of the cop-receiving chute device mounted on the feeder proper.
Figure 9:
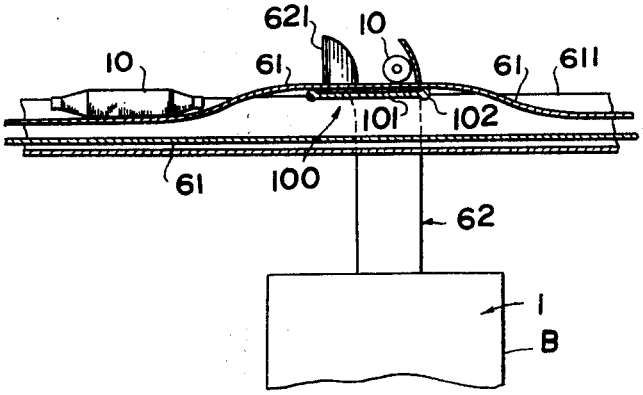
FIG. 9 is a sectional front view taken on the line 9—9 of FIG. 8.
Figure 10:
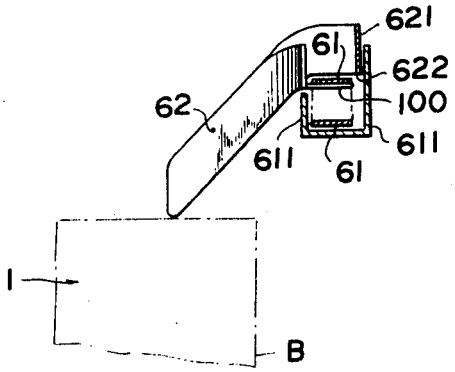
FIG. 10 is a sectional side view taken on the line 10—10 of FIG. 8.

Cop-supply unit C is preferably constructed as a chute device as shown in FIGS. 8 to 10. This chute device 62 comprises trough-shaped guide passageway 63 secured at the lower end to the containing section 1 of the feeder B, belt floating device 100 for belt conveyor 61 secured to the upper end of the guide passageway 63, and guide trough 621 for the cop 10 also secured to the upper end of the guide passageway 63 for floating the travelling belt 61.

The floating device 100 is so constructed that the bottom plate of the trough-shaped guide passageway 63 resting on lateral guide plate 611 on the cop take-out side of the belt conveyor 61 and facing to the belt path is inserted below the belt 61 for uplifting the latter from the upper end of the guide plate 611. Guide means 101 such as curved surface or rollers is provided on the both edges of the bottom plate or at least on the sides opposite to the direction of movement of the conveyor belt for reducing the wear and the resulting destruction of the belt 61.

Guide trough 621 is constructed of a pair of bent plates opened in the direction of movement of the conveyor belt 61. The foremost part of one of the bent plates is formed as an upright wall adjacent to the guide plate 611, and the other bent plate provides a slit 622 for belt passage between the guide passageway 63 and the bottom plate and extends along the inner surface of the guide plate 611. The cop 10 conveyed on the belt 61 guided by these bent plates is thereby safeguarded from falling laterally at the belt floating zone and can be diverted into passageway 63 from the opening between the bent plates.

In the embodiment shown in FIGS. 14 to 17, the guide rail 13 and the travelling rail 12 are mounted in juxtaposition on the front side of the thread winder A, and three feeder lines R, S, T connected to a threephase power source and a signal line X are provided in bus duct 112 mounted on one side of the travelling rail 12. A travelling cop feeder B mounted for reciprocating on the rails 12, 13 along the front side of the thread winder A is provided with a stop position control device and a cop-charging device for charging the cops 10 sequentially into each magazine 11 as it reciprocates along the thread winder, and a conveyor device C is mounted in position above the thread winder for replenishing the cops into the feeder.

This conveyor device C consists of an endless belt conveyor 61 mounted over the length of the winder A and running at a higher speed than that of the cop feeder B, a lifting conveyor 113 (FIG. 14) for supplying the cops to the conveyor 61, and stock hopper 114 for supplying the cops to the conveyor 113. The cops 10 contained in the hopper 114 are loaded by feed-out rotor 115 onto said lifting conveyor one by one in alignment with each other. The various components of the conveyor device C are driven in synchronism by motors $M_1$ and $M_2$.

The travelling cop feeder B consists of a chute device 62 (FIG. 16) slidably resting on said conveyor 61 for receiving and diverting the cops through its opening; a containing section 111 for containing a predetermined quantity of the cops 10 supplied through said chute device 62; a feed-out section 116 adjacent to the lower end of the containing unit for sequential transfer of the cops 10; a charging section 117 including a cop holder 30 adapted to receive the cops thus fed and to be raised and lowered for charging the cop into the magazine 11; a driving section 4 for driving the charging section; a changeover section **4*b* for reversing the direction of reciprocation of the feeder B at the extreme ends of the winder proper; and a stop position control section, not shown, for stopping the feeder in position for supplying the cops into the magazine. Said containing unit 111 has a bent guide passage 118 for the purpose of preventing the cops from levelling or assuming any other undesirable attitudes. Sensing members $K_1$, $K_2$ and $K_3$ are mounted in the upper, mid and lower sections and facing to the inside of the passage 118 for actuation by the cops 10, and limit switches $SW_1$, $SW_2$, $SW_7$ are operatively associated with said sensing members for bringing the conveyor belts 61 and 113 (FIG. 14) of the conveying device C to a standstill. The limit switch $SW_1$ (FIG. 16) senses the passage 118 filled to capacity for terminating the cop delivery into the containing unit, while the limit switches $SW_2$ and $SW_7$ are provided as fail safe devices for stopping the supply of cops in the case of filling of the passageway to capacity and as sensing devices for sensing the cop shortage and issuing an instruction signal for cop replenishment into the containing unit. Collector brushes 119, 120, 121 and 122 (FIGS. 15 and 17) are provided as current receiving device 49** on the lower part of the feeder, said brushes corresponding to the feeder lines R, S, T and the signal line X, respectively.

Figure 17:
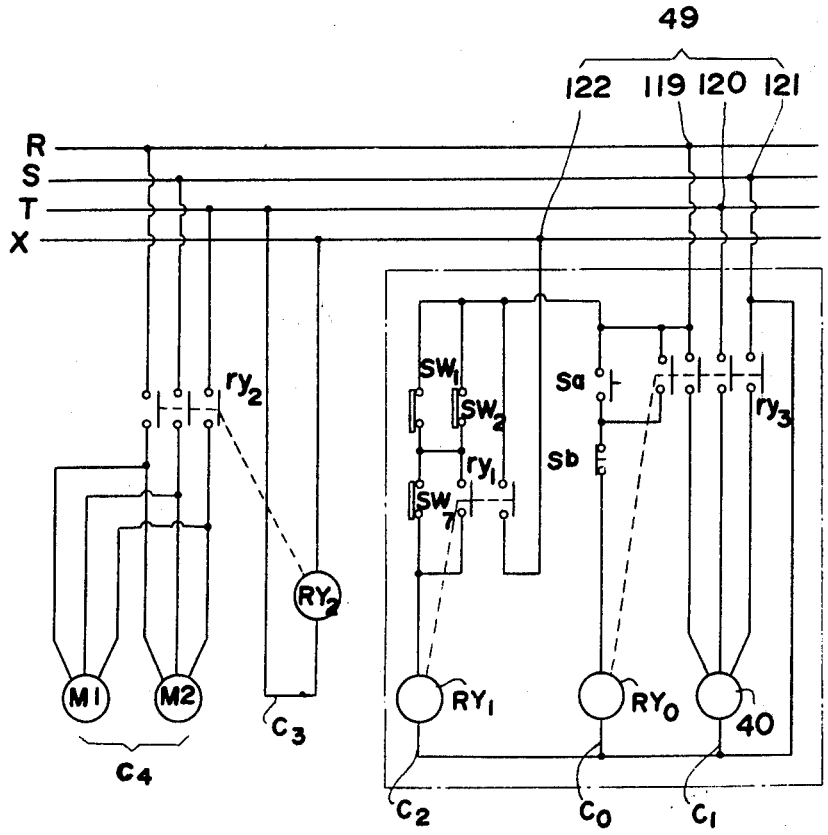
FIG. 17 is a control circuit diagram of the belt conveyor.

The driving control circuit used in the present embodiment is shown in FIG. 17 wherein $RY_0$, $RY_1$ and $RY_2$ denote relays, $ry_1$, $ry_2$ and $ry_3$ are relay contacts actuated by said relays, the numeral 40 denotes a feeder driving motor, M1 and M2 denote driving motors for lifting and supply conveyors 61, 113, S*a* and S*b* denote switches for driving and stopping the feeder, $C_0$, $C_1$ and $C_2$ are the circuits mounted to the conveying device and operable for transmitting the instructions for starting and cop replenishment, and $C_3$, $C_4$ are the circuits provided to the conveying device and operable on reception of signals transmitted from the feeder.

It is to be noted that the above circuits may be replaced by any other device for establishing a signal communication between the feeder B and the conveying device, such as a wireless communication system or a mechanical interlock changeover control device or a device controlled by light rays, electromagnetic radiation or sound waves.

The operation of the driving control circuit will be explained by referring to FIG. 17. When the push button switch S*a* of the cop feeder B is closed, the starter circuit $C_0$ is closed, and the motor circuit $C_1$ is closed through relay $RY_0$ for driving the motor 40 and the feeder B in reciprocation. When the quantity of cops 10 in the containing section 111 of the feeder B falls to a level lower than the sensing member $K_3$ and it becomes necessary to feed cops into the containing section, no pressure is applied to the sensing members $K_1$, $K_2$ and $K_3$. The limit switches $SW_1$, $SW_2$ and $SW_7$ are closed by the sensing members $K_1$, $K_2$ and $K_3$, and the circuit $C_2$ in the feeder B for transmitting the instructions for cop replenishment is closed. The instruction signal is transmitted from relay $RY_1$ through line R and signal line X to the conveying device C and energizes the relay $RY_2$ of the relay circuit $C_3$. The cop supply circuit $C_4$ is closed for driving the lifting and supply conveyors 61, 113. Thus, the cops 10 on the conveyor 61 can be supplied into the containing section 111 through the chute device 62 not only when the feeder B is stationary or travelling in the direction opposite to that of the conveyor 61, but when the feeder is travelling in the same direction as the conveyor 61, thanks to the greater velocity of the conveyor 61 than of the feeder B. When the cops supplied into the containing section 111 act on the sensing member $K_3$ for opening the limit switch $SW_7$, the supply conveyor is still driven due to the self-hold of the relay $R_1$ and the closure of the limit switches $SW_1$, $SW_2$. As the cops are stored further and act on the sensing member $K_2$ for opening the limit switch $SW_2$, since the limit switch $SW_1$ is still closed, the supply of cops is continued through the conveyor belt. When the cops are stored further and act on the sensing member $K_1$ for opening the limit switch $SW_1$, the circuit $C_2$ for transmitting the instruction signal for cop replenishment is opened for bringing the supply and lifting conveyors 61, 113 to a standstill and terminating cop replenishment. When the cop quantity in the containing section falls to a level lower than the sensing member $K_3$, as the cops are supplied to each magazine from the reciprocating cylinder, the conveying device is started in the same way as above for preforming cop-replenishing operation. The feeder B is brought to a stop by depressing the switch S*b*. In the meantime, the sensing member $K_2$ is provided for the purpose of preventing malfunction caused by chattering of the uppermost sensing member $K_1$ resulting from each cop charging operation.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Apparatus for automatically supplying cops to a plurality of rotatable magazines of a thread winder, each of said magazine having a plurality of pockets for holding cops, comprising guide means proximate said thread winder, said guide means being essentially as long as said thread winder, a movable cop-feeder on said guide means, first driving means for moving said cop-feeder back and forth along the length of said guide means and into registry with any of said magazines, and halting means for halting said cop-feeder in registry with any of said magazines, said cop-feeder including a cop-storage section, a rotatable cop-holder movable between two positions, said cop-holder having at least one cavity for holding a cop, said cop-holder in the first of said positions being adapted for receiving at least one cop from said cop-storage section and in the second of said positions being adapted for transferring at least one cop to a magazine, means for feeding cops from said cop-storage section to said cop-holder, means for moving said cop-holder reciprocally between said two positions, said cop-storage section and said magazine being in spaced-apart relation, and means for transferring cops by gravity from said cop-holder to said magazine.

2. The apparatus as defined in claim 1 further comprising first sensing means for detecting whether a cop is present in a cavity in said cop holder, and first stopping means controlled by said first sensing means for prevention of transfer of a cop from said storage section to said cop-holder when a cop is present in said cavity.

3. The apparatus as defined in claim 1 further comprising second sensing means for detecting whether a cop is present in a pocket in a magazine when said cop-holder is in position for transfer of a cop to said pocket, and second stopping means, controlled by said second sensing means for preventing transfer of a cop from said cop-holder to said pocket of said magazine when a cop is present in same.

4. The apparatus as defined in claim 3 wherein said cop-holder includes a hook, spring-loaded toward said magazine and adapted to ride over the surface of a rotatory magazine until said hook is engaged by the rim of a pocket and then to engage said rim of said pocket, thereby entraining said cop-holder into synchronous rotation with said magazine; and second circuitry means controlled by the position of said hook and connected to said second stopping means for preventing transfer of a cop of said magazine when said hook is not engaged by the rim of a pocket.

5. The apparatus as defined in claim 1 further comprising automatic means for automatic transfer of cops to said storage section of said cop-feeder, said automatic means being affixed to and travelling with said cop-feeder.

6. The apparatus as defined in claim 5 wherein said storage section has therein upper and lower limit sensors and switching means for contolling said means for driving said conveyor, said limit sensors closing said switching means when the number of cops in said storage section falls below a selected limit and opening said switching means when the number of cops in said storage section rises above a selected limit.

7. The apparatus as defined in claim 1, further comprising a belt conveyor for bringing cops to said cop-feeder.

8. The apparatus as defined in claim 7 wherein said automatic means is a chute for transferring cops from said conveyor to said storage section of said cop-feeder, said chute having a receiving end so oriented with respect to the direction of travel of said conveyor as to accept cops from said conveyor, and second driving means for driving said conveyor, said second driving means being capable of moving said belt conveyor sufficiently rapidly to bring cops to said chute at a rate greater than said cop-feeder can feed cops to a magazine regardless of whether said feeder is stationary or travelling in the moving direction of said conveyor.

9. The apparatus as defined in claim 8 wherein said automatic means further comprises a guide plate and belt lifter for moving said belt upward to permit passage of said guide plate under said belt and for directing cops into said receiving end of said chute.

10. The apparatus as defined in claim 1 wherein said first driving means includes first circuitry means for bringing said cop-feeder into registry with alternate magazines for feeding cops thereinto as it travels in one direction from one end of said thread winder to the other and for bringing said cop-feeder into registry with the intermediate magazines for the same purpose as the cop-feeder makes the return trip.

11. The apparatus as defined in claim 10 wherein said first circuitry means includes means for reversing the direction of travel of said cop-feeder on reaching either end of said thread winder.

12. The apparatus as defined in claim 8 wherein said first circuitry means is adapted to cut off the power to said first driving means before said cop-feeder comes into registry with a magazine, the inertia of said cop-feeder being great enough to bring same into the desired registry, whereby said cop-feeder comes into registry at a lower velocity than would be the case if it were power-driven into registry, and decreasing the shock and vibration involved in bringing said cop-feeder to a halt.

13. The apparatus as defined in claim 1 wherein said cops are held parallel to each other in said storage sections.

14. Method for automatically supplying cops from a movable cop-feeder to a multiple-position automatic thread winder having a magazine at each position, each magazine having therein a plurality of pockets for holding cops, said cop-feeder including a cop-storage section, a cop-holder having at least one cavity therein for holding a cop and at least one channel for transferring a cop from said cop-storage section to said cavity, said cop-holder being reciprocatable from said channel to said magazine, comprising the steps of moving said cop-feeder into registry with a winding unit, bringing said cop-holder into position for receiving a cop in said cavity from said cop-storage section through said channel, detecting whether said cavity is empty, feeding a cop from said channel into said cavity if empty, moving said cop-holder to said magazine, bringing said cavity into registry with a pocket in said magazine, detecting whether said pocket is empty, and transferring said cop by gravity from said cavity to said pocket if said pocket is empty.

15. The method as defined in claim 14, further comprising the steps of returning said cop-holder to said receiving position and moving said cop-feeder into position for transferring cops to another magazine.

16. The method as defined in claim 15, wherein said other magazine is the next but one from said magazine.

17. The method as defined in claim 15 wherein said magazines are spaced along a line having two ends, and said cop-feeder is moved in a first direction along said line, stopping at each alternate winding position for feeding cops as required to the corresponding magazine, said interrupted movement in said first direction continuing until one end of said line is reached, reversing the direction of movement of said cop-feeder, stopping said cop-feeder at the remaining winding positions for feeding cops as required to the corresponding magazines, continuing said interrupted movement in said reversed direction until the other end of said line is reached and converting the direction of movement of said cop-feeder to said first direction.

18. The method as defined in claim 15 further comprising the steps of cutting off the power to the driving means used for moving said cop-feeder from one magazine to said other magazine sufficiently short of completion of the transfer to allow said cop-feeder to slow down as the remainder of the transfer is completed by inertia, thereby minimizing shock and vibration as said cop-feeder is brought into position with respect to said other magazine.

* * * * *